US005833442A

United States Patent [19]

Park et al.

[11] Patent Number: 5,833,442

[45] Date of Patent: Nov. 10, 1998

[54] SCROLL-TYPE COMPRESSOR HAVING IMPROVED PRESSURE EQUALIZING PASSAGE CONFIGURATION

[76] Inventors: Wan Pyo Park, 24-1 Dongsanri Tangjungmyun, Asan City, Chungnam; Hiun Won, 253 Namdaemun-ro 5-Ka, Jung-ku, Seoul; Do Sig Choi; Yong Hun Cho, both of 24-1 Dongsanri, Tangjungmyun, Asan City, all of Rep. of Korea

[21] Appl. No.: 751,018

[22] Filed: Nov. 15, 1996

[30] Foreign Application Priority Data

Nov. 18, 1995 [KR] Rep. of Korea ..... 1995-42098

[51] Int. Cl.[6] ..... F04C 18/04

[52] U.S. Cl. ..... 418/1; 418/55.5; 418/57

[58] Field of Search ..... 418/1, 55.5, 57

[56] References Cited

U.S. PATENT DOCUMENTS

| | | | |
|---|---|---|---|
| 3,600,114 | 8/1971 | Dvorak et al. | 418/55.5 |
| 3,874,827 | 4/1975 | Young | 418/55.5 |
| 3,884,599 | 5/1975 | Young et al. | 418/55.5 |
| 3,924,977 | 12/1975 | McCullough | 418/55.5 |
| 4,192,152 | 3/1980 | Armstrong et al. | 62/402 |
| 4,216,661 | 8/1980 | Tojo et al. | 62/505 |
| 4,437,820 | 3/1984 | Terauchi et al. | 418/55.4 |
| 4,475,360 | 10/1984 | Suefuji et al. | 62/324 |
| 4,475,874 | 10/1984 | Sato | 418/55.5 |
| 4,496,296 | 1/1985 | Arai et al. | 418/55.5 |
| 4,505,651 | 3/1985 | Terauchi et al. | 417/440 |
| 4,557,675 | 12/1985 | Murayama et al. | 418/55.5 |
| 4,696,630 | 9/1987 | Sakata et al. | 418/55.5 |
| 4,818,195 | 4/1989 | Murayama et al. | 418/15 |
| 4,958,993 | 9/1990 | Fujio | 418/55.3 |
| 4,992,032 | 2/1991 | Barito et al. | 418/55.4 |
| 5,090,878 | 2/1992 | Haller | 418/1 |
| 5,256,044 | 10/1993 | Nieter et al. | 418/55.5 |

FOREIGN PATENT DOCUMENTS

| | | | |
|---|---|---|---|
| 53-119412 | 10/1978 | Japan | 418/55.5 |
| 4-219485 | 8/1992 | Japan | 418/55.5 |

*Primary Examiner*—John J. Vrablik
*Attorney, Agent, or Firm*—Finnegan, Henderson, Farabow, Garrett & Dunner, L.L.P.

[57] ABSTRACT

A scroll-type compressor has a scroll plate with at least first and second pressure equalizing passages formed in its end plate such that the first and second pressure equalizing passages will be in the same crescent shaped pocket during at least a portion of a crescent shaped pocket's radially inward movement. The minimum pressure in a back pressure pocket will be adequate to maintain a good seal, any pressure increases will increase in accordance with the increased pressure in the crescent shaped pockets. At no point are both of the pressure equalizing passages blocked and, therefore, the pressure in the interior space does not overwhelm the effective functioning of the back pressure pocket.

33 Claims, 8 Drawing Sheets

SCROLL-TYPE COMPRESSOR HAVING IMPROVED PRESSURE EQUALIZING PASSAGE CONFIGURATION

BACKGROUND OF THE INVENTION

1. Field of the Invention

This invention relates to scroll-type compressors, and more particularly to a pressure equalizing passage configuration that improves the efficiency and other performance characteristics of scroll-type compressors.

2. Description of the Related Art

A scroll-type compressor is a high efficiency compressor used in air conditioning systems, vacuum pumps, expanders, and engines. An example of the prior art configuration is illustrated in FIGS. 1–3. Scroll compressor 10 comprises a hermetic casing 20, a shaft 30, a fixed scroll plate 40, orbiting scroll plate 50, and upper frame. Each scroll plate 40 and 50 has a spiral shaped wrap 41 and 51, respectively. These wraps interfit to form an interior space and a series of crescent shaped pockets (illustrated in FIG. 3). A pressure equalizing passage 52 is formed in the orbiting scroll plate to interconnect the interior space with back-pressure pocket 80 of air bushing 90.

The orbiting scroll wrap 51 is rotationally displaced 180° relative to the stationary scroll wrap 41. An orbiting movement is imparted to the orbiting scroll 50 by an Oldham's coupling 70 fitted into a lower frame 60. The Oldham's coupling 70 translates rotational movement, e.g., from a rotating shaft 30, to an orbiting movement. A typical orbiting scroll will orbit at about 3600 rpm. As the orbiting scroll 50 orbits around the stationary plate 40, line contacts created between the interfitted wraps form crescent shaped pockets which begin to move radially inwards towards the center of the plates. As the crescent shaped pockets move radially inwards they reduce in volume, and therefore compress the fluid contained within the pockets. A discharge port at the center of one of the plates receives high pressure from the crescent shaped pockets when they terminate at the center. By this process, low pressure fluid is introduced at the exterior perimeter of the plates and is encased within the crescent shaped pockets as the pockets begin to form. As the pockets move inwardly, the fluid pressure increases until the fluid is discharged through the discharge port.

The scroll-type compressor has many advantages over other compressors, such as reciprocating compressors. First, the continuous movement of the scroll-type compressor does not require recompression or re-expansion. Second, the continuous and smooth operation of the scroll-type compressor eliminates problems associated with the reciprocating movement of other compressors (e.g., metal fatigue is reduced), and produces about one tenth of the torque. Third, the crescent shaped pockets are paired and offset at 180° thereby reducing non-symmetrical pressures and the vibrations and noise attendant thereto. Finally, because of their efficiency, scroll-type compressors may be smaller and lighter, and require fewer parts, resulting in lower manufacturing costs.

One of the most important concerns in scroll-type compressor efficiency is the tendency of the crescent shaped pockets to leak. Leakage can occur either though the vertical line contacts formed at the orbiting and stationary scroll plate interface at the front or back end of each pocket, or at the horizontal seals formed at the tips of a wrap 41*a* and 51*a* and the flat surface of the opposing scroll plate 51*b* and 41*b*. Most fluid pressure loss is through the horizontal seals.

Therefore efforts have focused on minimizing fluid leakage past the tips of the wraps. One way of doing so is to minimize the clearance between scroll tips and the opposing plates. However, increasing the contact pressure on the scroll plate tips will cause premature wearing of the wrap tips and decrease the service life of the scroll plate.

The opposite problem is created by the pressure increase within the interior space which tends to produce an axial force separating the scroll plates. To counteract this separating axial force, air bushings 90 have been used. These air bushings 90 have back-pressure pockets 80 which are interconnected with the interior space through pressure equalizing passages 52. Therefore, as the pressure in the interior space increases, the counteracting pressure in the back-pressure pocket will increase accordingly, thereby improving the efficiency of the compressor. An example of a prior art scroll-type compressor having this configuration is described in U.S. Pat. No. 4,557,675 to Murayama et al.

Applicants have studied this prior art configuration and discovered that certain problems are encountered during operation. FIG. 3 demonstrates the operation of a scroll-type compressor.

As shown in FIG. 3A, an arbitrarily selected point in the compression cycle, the pressure equalizing passage 52 will not be covered by the stationary scroll wrap 41. During an orbiting motion cycle, however, the tip of the stationary scroll wrap 41 begins to cover up the pressure equalizing passage 52. As the cycle progresses, the pressure equalizing passage 52 becomes completely covered (See FIG. 3C) and "exits" from the stationary scroll wrap on the other side to another, lower pressure crescent shaped pocket (See FIGS. 3D and 3E). When the wrap covers the pressure equalizing passage, it interferes with the communication between the interior space and the air bushing's back-pressure pocket. This interference has a deleterious effect on the overall performance of the scroll-type compressor. During the interference, the pressure in the crescent shaped pocket increases while the pressure in the back-pressure pocket remains constant. The resulting pressure imbalance axially forces the scroll plates apart and causes leakage past the wrap tips. Although this interference occurs during a very brief time period, it nonetheless represents a significant portion of the cycle.

For example, FIG. 6 illustrates the cyclical path of a pressure equalizing passage formed in the orbiting scroll. As the passage passes underneath the wrap tip 41 the intercommunication between the interior space and the air bushing's back-pressure pocket is interrupted. This interruption occurs over 60°–70° of the 360° cycle. In other words blockage of the pressure equalizing passage occurs during 60/360–70/360 or 16.7%–19.4% of the orbiting cycle; the compressor fails to operate at peak efficiency during almost 20% of the compression cycle. The same problem occurs when two pressure equalizing passages are symmetrically formed in the scroll plate; because they are symmetrically configured, they are blocked at the same stage of each cycle.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention comprises a scroll plate for use in a scroll-type fluid compressor, having an end plate with a center point, and a spiral shaped wrap for interfitting with a spiral shaped wrap on a second scroll plate to thereby form a series of moveable, crescent-shaped pockets which reduce in volume as they move radially inward towards the center point. The end plate has a first hole formed therein at a distance from the center point and a second hole formed therein at a distance from the center point, wherein the first and second holes are formed in the end plate such that the first and second holes will be in the same crescent shaped pocket during at least a portion of a crescent shaped pocket's radially inward movement. The first and second pressure equalizing passages are positioned at locations in the end plate that prevent the first and second pressure equalizing passages from simultaneously being completely blocked by the spiral shaped wrap of the second plate at any time when the plates rotate relative to each other.

It is to be understood that both the foregoing general description and the following detailed description are exemplary and explanatory, and are not restrictive of the invention as claimed.

DETAILED DESCRIPTION OF THE PREFERRED EMBODIMENT

Figure 1:
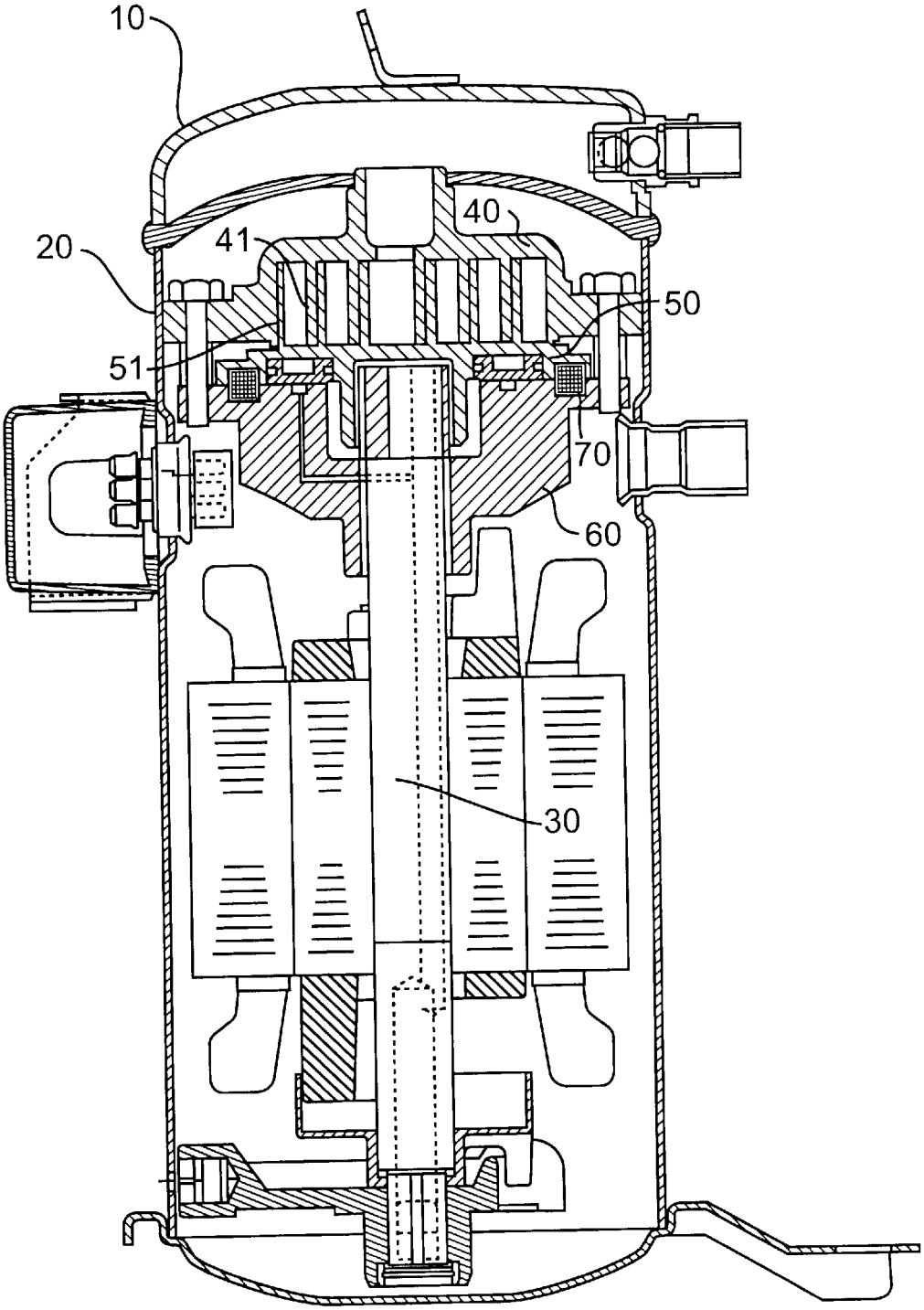
FIG. 1 PRIOR ART
FIG. 1 is a sectional view of a scroll-type fluid compressor.
Figure 2:
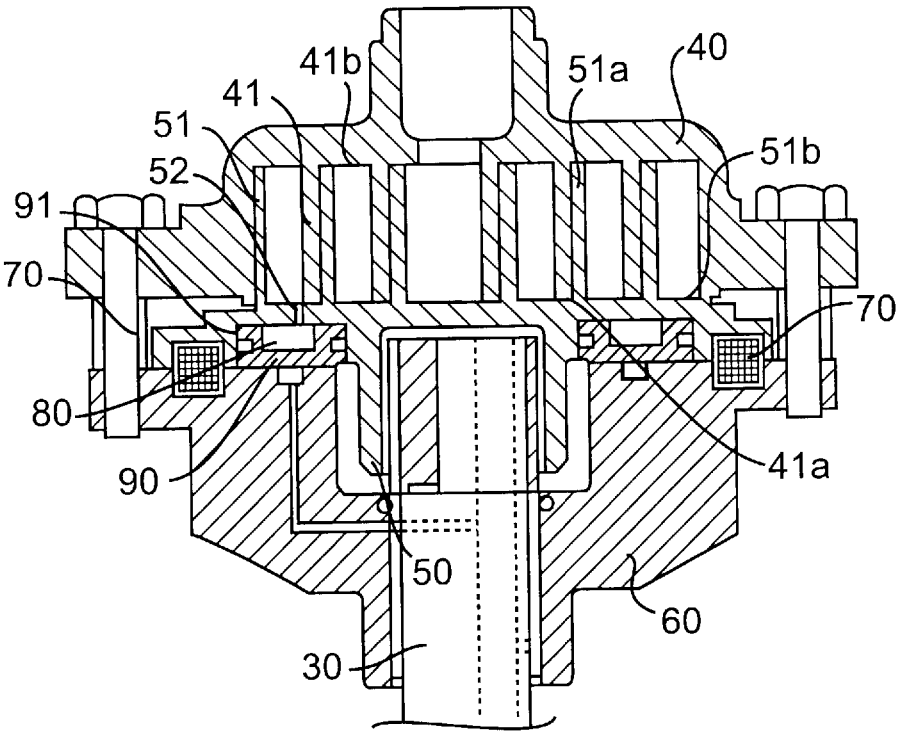
FIG. 2 PRIOR ART
FIG. 2 is a sectional view of a portion of a scroll-type fluid compressor showing two interfitting scroll plates.
Figure 3A:
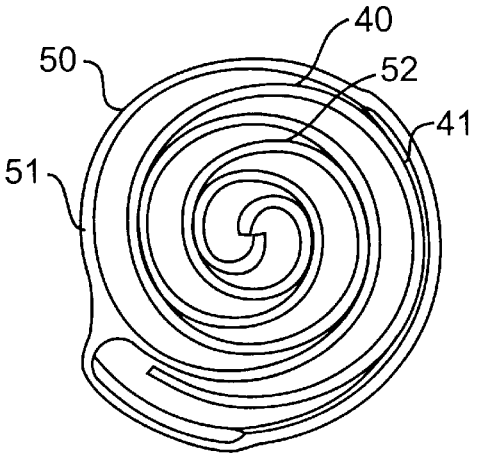
FIG. 3a PRIOR ART
FIGS. 3A–3E are views showing a prior art scroll plate during a compression cycle.
Figure 3B:
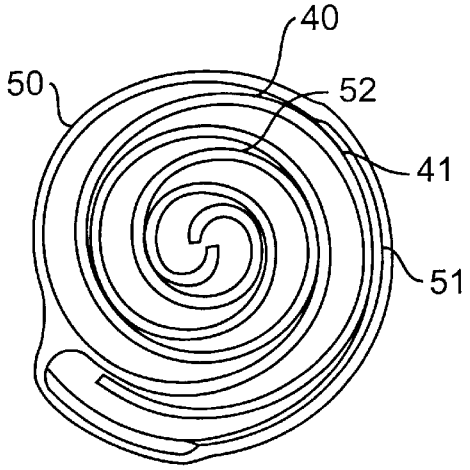
FIG. 3b PRIOR ART
Figure 3C:
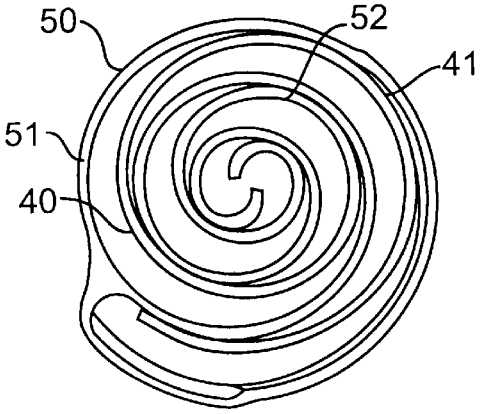
FIG. 3c PRIOR ART
Figure 3D:
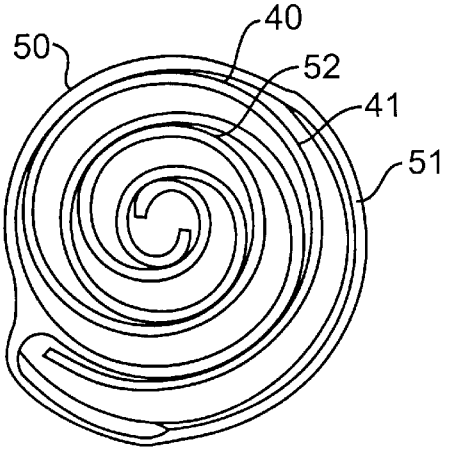
FIG. 3d PRIOR ART
Figure 3E:
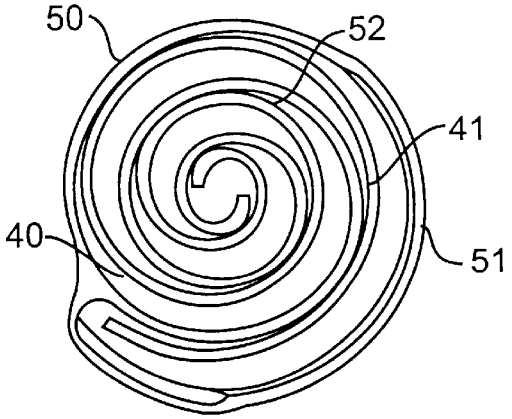
FIG. 3e PRIOR ART
Figure 4A:
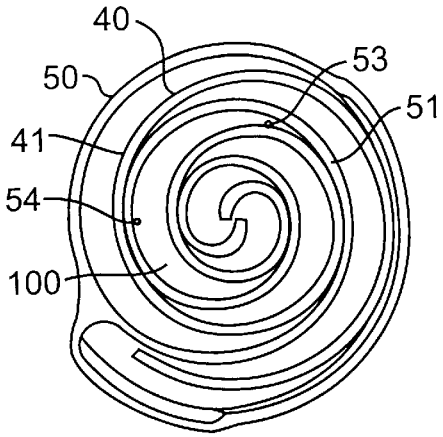
FIGS. 4A–4E are views showing a scroll plate according to the invention during a compression cycle.
Figure 4B:
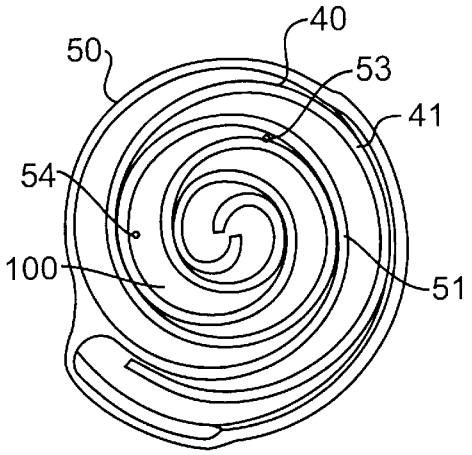
Figure 4C:
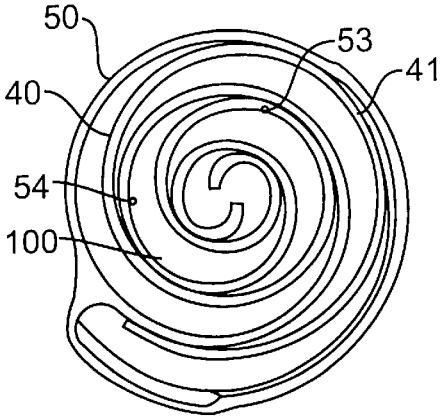
Figure 4D:
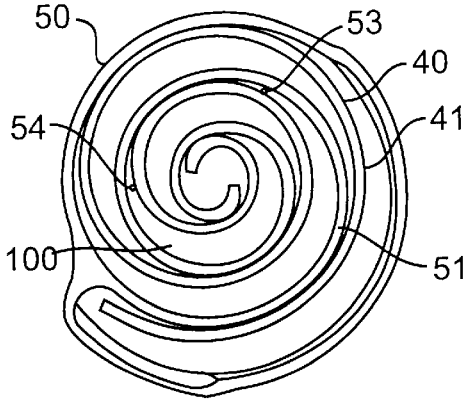
Figure 4E:
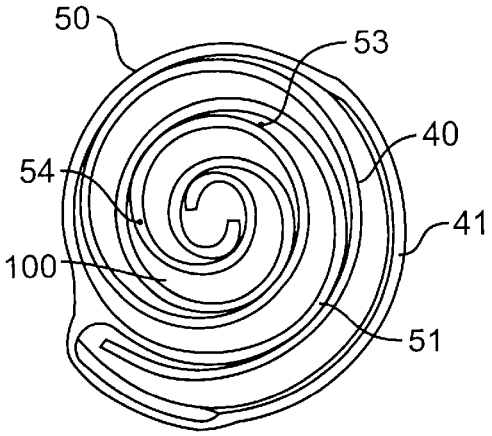

FIGS. 4A–4E demonstrate the compression cycle of a scroll wrap having a pressure equalizing passage configuration according to the invention. In FIG. 4A a stationary scroll wrap 41 intermeshes with an orbiting scroll wrap 51. The orbiting scroll plate has two holes 53 and 54 drilled through its end plate. The holes are configured so that there is never a time in the cycle of the scroll plate orbit that communication between the interior space and the back pressure passage is interrupted.

FIG. 4A illustrates the interaction between the orbiting scroll wrap 51 and stationary scroll wrap 41 at an arbitrarily selected portion of the compression cycle. The orbiting scroll wrap 51 is formed on the orbiting scroll plate 50, and the stationary scroll wrap 41 is formed on the stationary scroll plate 40. In FIG. 4A, both pressure equalizing passages 53 and 54 are in the same crescent shaped pocket. As the cycle progresses (FIG. 4B) one of the pressure equalizing passages 53 is beginning to be covered by the stationary scroll wrap 41. The other pressure equalizing passage 54 is left open to continue to interconnect the back pressure pocket with the crescent shaped pocket 100. The cycle progresses and the pressure equalizing passage 53 that is covered by the stationary scroll wrap 41 continues to pass underneath the stationary scroll wrap 41 (see FIGS. 4C and D) to the other side where it "exits" from underneath the stationary scroll wrap 41 into another crescent shaped pocket, while at the same time, the other pressure equalizing passage 54 is now covered by the pressure equalizing wrap 41 (See FIG. 4E).

Figure 7:
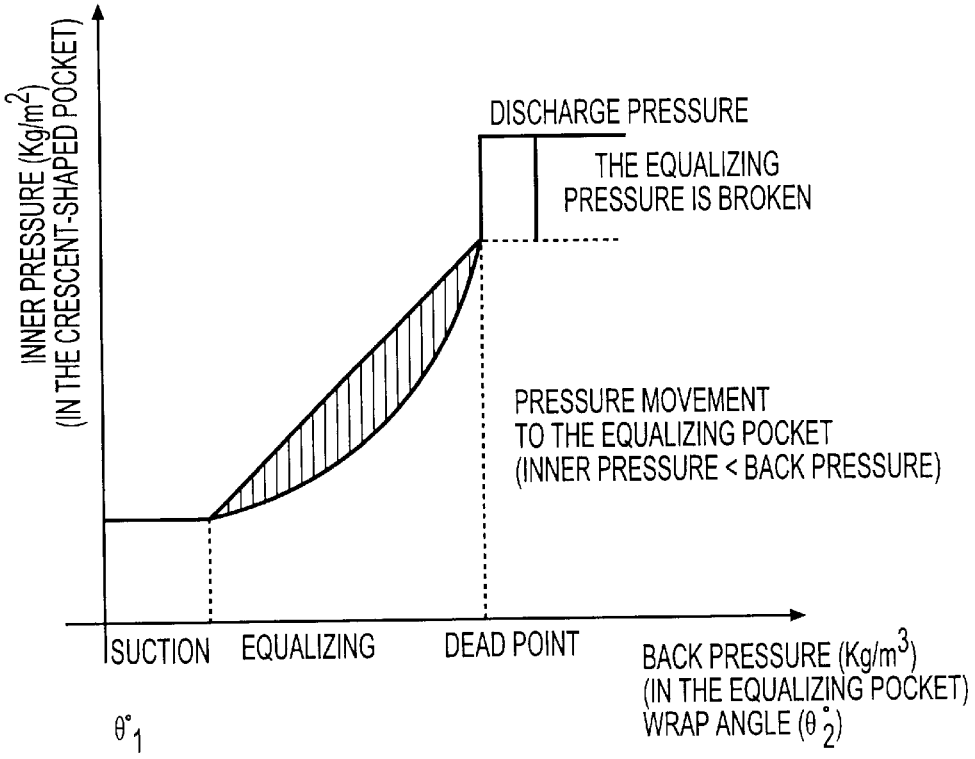
FIG. 7 PRIOR ART
FIG. 7 is a diagram showing the relative pressures in a crescent shaped pocket and a back-pressure pocket in a prior art device.
Figure 8:
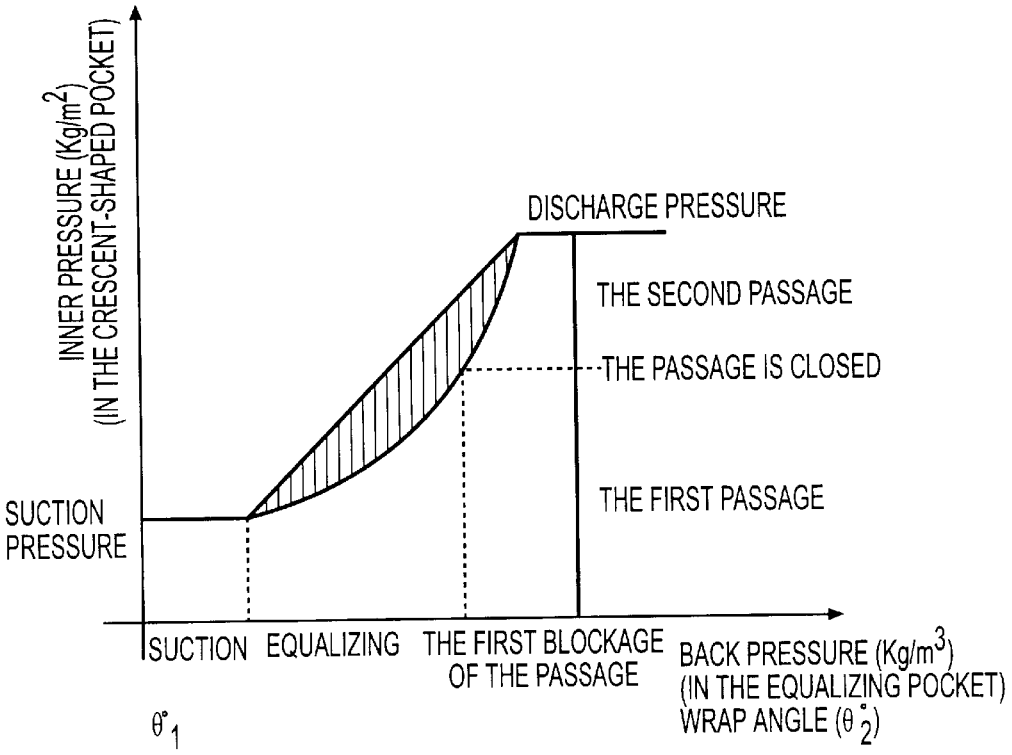
FIG. 8 is a diagram showing the relative pressures in a crescent shaped pocket and a back-pressure pocket in a device according to the invention.

According to this configuration, the first pressure equalizing passage is positioned at the "optimal point," a position on the orbiting scroll wrap that has been determined to be a position in which there will be good axial compliance, i.e., the pressure in the back pressure passage 80 is adequate to keep the axial seal between the tips 41*a* and 51*a,* and the plate surfaces 41*b* and 51*b* on the scroll plates. The second pressure equalizing passage 54 is positioned at a higher pressure position (i.e., at a point "downstream" in the wrap spiral. This ensures that the minimum pressure in the back pressure pocket will be adequate to maintain a good seal between the wrap tips and the opposing scroll plates, while if the pressure increases, it will increase in accordance with the increased pressure in the crescent shaped pockets. At no point, however, are both of the pressure equalizing passages blocked and, therefore, the pressure in the interior space does not overwhelm the effective functioning of the back pressure pocket as it does in the prior art configuration. (Compare FIG. 7 with FIG. 8).

Figure 5A:
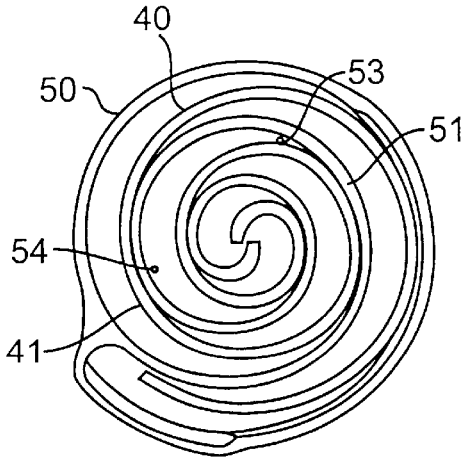
FIGS. 5A–5E are views of another scroll plate configuration during a compression cycle.
Figure 5B:
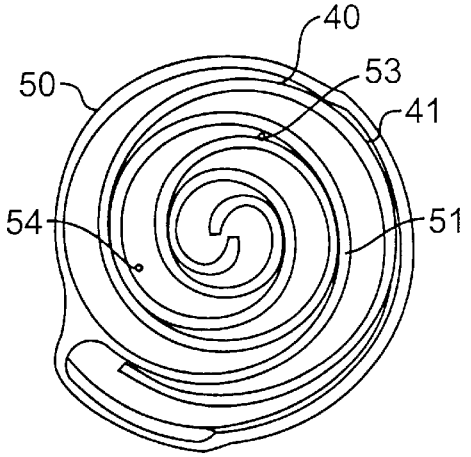
Figure 5C:
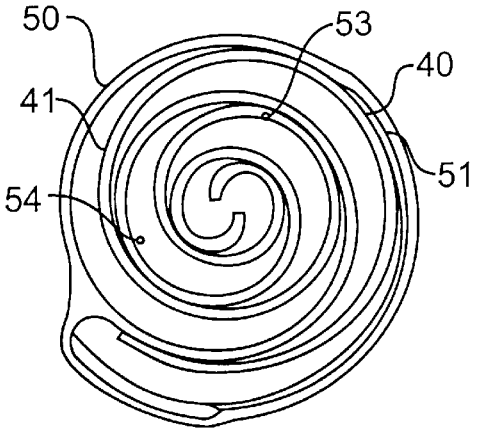
Figure 5D:
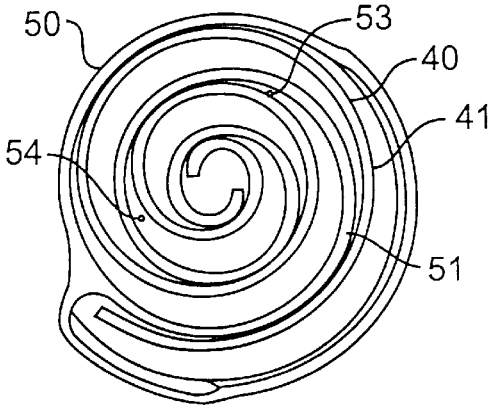
Figure 5E:
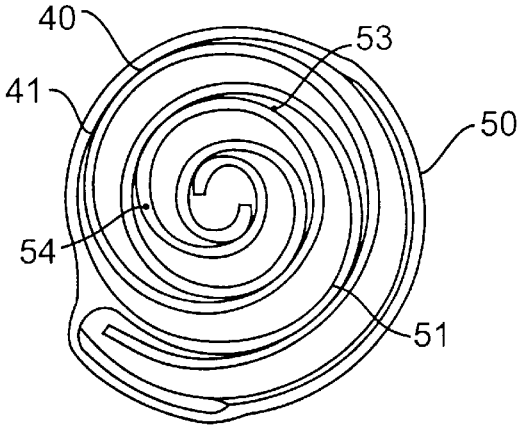
Figure 6:
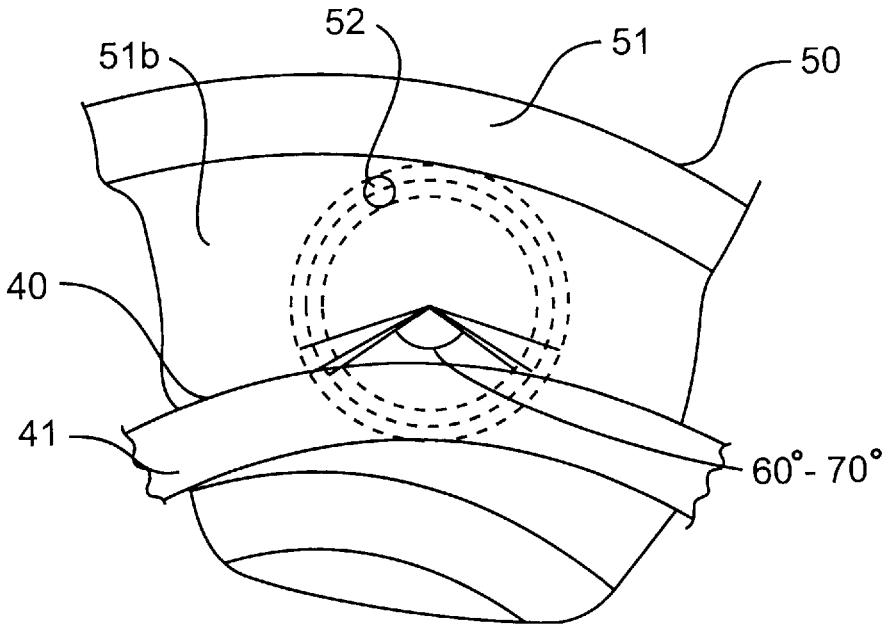
FIG. 6 PRIOR ART
FIG. 6 is a view showing the relative movement between a pressure equalizing passage and a stationary scroll plate wrap.

FIGS. 5A–5E illustrate what may happen if the pressure equalizing passages are spaced too far apart. FIG. 5A illustrates the interaction between the orbiting scroll wrap 51 and stationary scroll wrap 41 at an arbitrarily selected portion of the compression cycle. The orbiting scroll wrap 51 is formed on the orbiting scroll plate 50, and the stationary scroll wrap 41 is formed on the stationary scroll plate 40. In FIG. 5A both pressure equalizing passages 53 and 54 are in the same crescent shaped pocket. As the cycle progresses (FIG. 5B) one of the pressure equalizing passages 53 is beginning to be covered by the stationary scroll wrap 41, leaving the other pressure equalizing passage 54 open to continue to interconnect the back pressure pocket with the crescent shaped pocket 100. The cycle progresses and the pressure equalizing passage 53 that is covered by the stationary scroll wrap 41 continues to pass underneath the stationary scroll wrap 41 (see FIGS. 5C and 5D) to the other side where it "exits" from underneath the stationary scroll wrap 41 into another, lower pressure crescent shaped pocket. In this non-preferred configuration, however, the other pressure equalizing passage 54 is not now covered by the pressure equalizing wrap 41, but, rather stays open in the higher pressure crescent shaped pocket (See FIG. 5E). A pressure leak will therefore develop from the higher pressure crescent shaped pocket to the lower pressure crescent shaped pocket with a corresponding loss in volumetric efficiency.

The inventors have therefore determined the pressure equalizing passages should be spaced at a distance between 90 and 120 degrees from each other. The inventors have also determined that the pressure equalizing passages should be substantially equal in width to the wrap wall thickness (See FIG. 9F). In other words, if the size of the pressure equalizing passage is equal to the wrap wall thickness or as close to the wrap thickness as possible and still be entirely blocked by the wrap, the blockage time is minimized and the compressor will be more efficient. If the size of the pressure equalizing passage is too large in comparison with the wrap thickness, a pressure leak from high to low pressure crescent shaped pockets will occur.

Figure 9A:
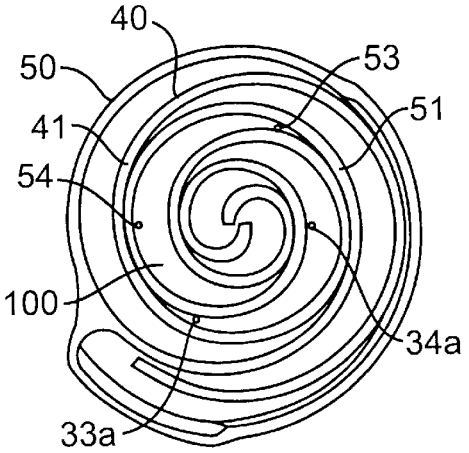
FIGS. 9A–9F are views showing a scroll plate configuration according to a second embodiment of the invention during a compression cycle.
Figure 9B:
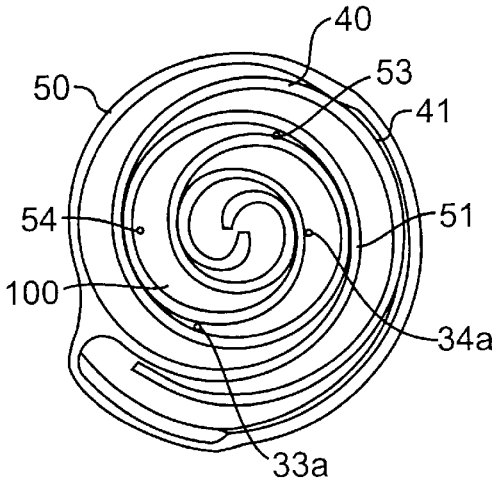
Figure 9C:
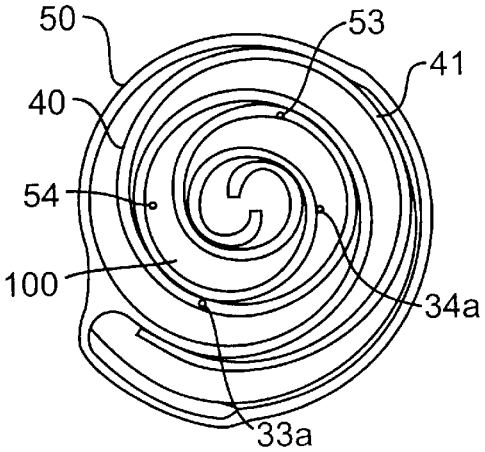
Figure 9D:
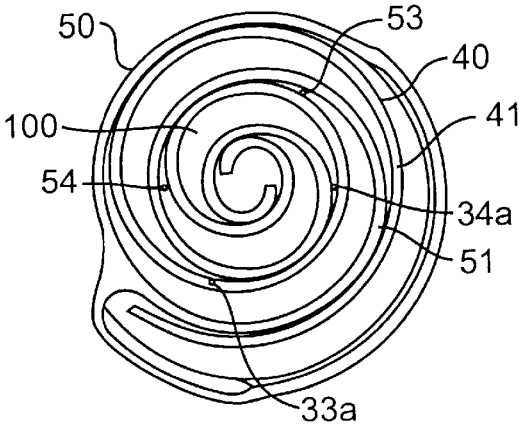
Figure 9E:
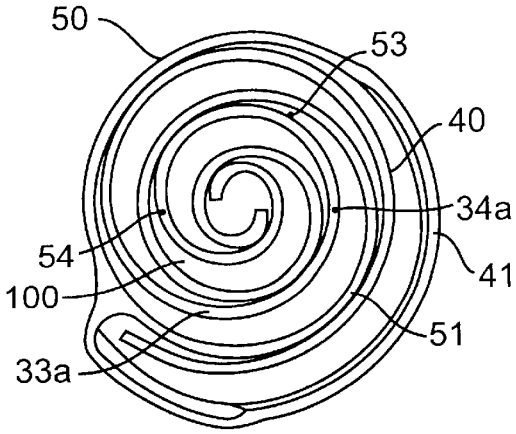
Figure 9F:
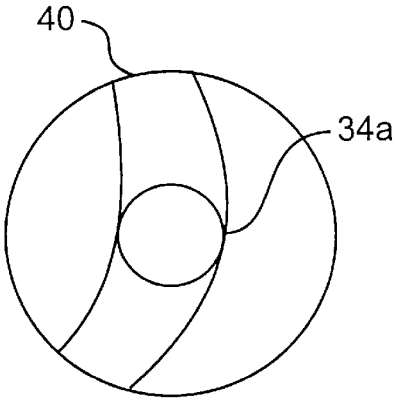

FIGS. 9A–9E illustrate a second embodiment of the invention. FIG. 9A illustrates the interaction between the orbiting scroll wrap 51 and stationary scroll wrap 41 at an arbitrarily selected portion of the compression cycle. The orbiting scroll wrap 51 is formed on the orbiting scroll plate 50, and the stationary scroll wrap 41 is formed on the stationary scroll plate 40. In FIG. 9A both pressure equalizing passages 53 and 54 are in the same crescent shaped pocket. A second set of pressure equalizing passages 33*a* and 34*a* are also formed offset from the first set of pressure equalizing passages 53 and 54 by 180 degrees. Because of this 180 degree offset, pressure equalizing passage 33*a* correlates with pressure equalizing passage 53 and pressure equalizing passage 34*a* correlates with 54.

As the cycle progresses (FIG. 4B) the first correlating pressure equalizing passages 53 and 33*a* are beginning to be covered by the stationary scroll wrap 41, leaving the other pressure equalizing passages 54 and 34*a* open to continue to interconnect the back pressure pocket with the crescent shaped pocket 100. Because the pressure equalizing passages 54 and 34*a* are offset by 180 degrees, there is no pressure leakage between their respective crescent shaped pockets—their internal pressures will be approximately equal at all relevant times. The cycle progresses and the pressure equalizing passages 53 and 33*a* which are covered by the stationary scroll wrap 41 continue to pass underneath the stationary scroll wrap 41 (see FIGS. 9C and 9D) to the other side where they "exit" from underneath the stationary scroll wrap 41 into other crescent shaped pockets, while at the same time, the other pressure equalizing passages 54 and 34*a* are now covered by the pressure equalizing wrap 41 (See FIG. 4E). Thus, at least two pressure equalizing passages are located in crescent shaped pockets having approximately equal pressures at all times. The resulting improvement in volumetric efficiency increases the overall efficiency of the compression cycle.

It will be apparent to those skilled in the art that various modifications and variations can be made in the disclosed process and product without departing from the scope or spirit of the invention. For instance, the pressure equalizing passages may be formed in the stationary scroll in the event the back pressure pocket is positioned to provide the axial sealing force to the stationary scroll. Other embodiments of the invention will be apparent to those skilled in the art from consideration of the specification and practice of the invention disclosed herein. It is intended that the specification and examples be considered as exemplary only.

What is claimed is:

1. A scroll plate for use in a scroll-type fluid compressor, comprising an end plate having a center point, and a spiral shaped wrap for interfitting with a spiral shaped wrap on a second scroll plate to thereby form a series of moveable, crescent-shaped pockets which reduce in volume as the plates rotate relative to each other about the center point;

said end plate having a first pressure equalizing passage formed through the plate at a distance from said center point and a second pressure equalizing passage formed through the plate at a distance from said center point, wherein said first and second pressure equalizing passages are positioned at locations in the end plate that permit said first and second pressure equalizing passages to be in the same crescent shaped pocket at some time, but prevent said first pressure equalizing passage from being open in a crescent shaped pocket at the same time said second pressure equalizing passage is open in a different crescent shaped pocket when the plates rotate relative to each other to thereby prevent pressure leakage between high and low pressure crescent shaped pockets.

2. The scroll plate of claim 1, wherein a line from said center point to said first pressure equalizing passage and a line from said center point to said second pressure equalizing passage define an angle greater than or equal to 90° and less than or equal to 120°.

3. The scroll plate of claim 1, wherein said spiral shaped wrap has a wall thickness, said first and second pressure equalizing passages are holes having a diameter, said wall thickness being greater than or substantially equal to said hole diameter so that the spiral shaped wrap completely covers each hole at some time when the plates rotate relative to each other.

4. The scroll plate of claim 3, wherein said wall thickness is substantially equal to said hole diameter.

5. The scroll plate of claim 1, wherein said end plate has third and fourth pressure equalizing passages formed through the plate, said third pressure equalizing passage being formed at a distance from said center point and offset 180° from said first pressure equalizing passage, said fourth pressure equalizing passage being formed at a distance from said center point, wherein said third and fourth pressure equalizing passages are positioned at locations in the end plate that permit said third and fourth pressure equalizing passages to be in the same crescent shaped pocket at some time when the plates rotate relative to each other.

6. The scroll plate of claim 5, wherein a line from said center point to said third pressure equalizing passage and a line from said center point to said fourth pressure equalizing passage define an angle greater than or equal to 90° and less than or equal to 120°.

7. A scroll plate for use in a scroll-type fluid compressor, comprising an end plate having a center point, and a spiral shaped wrap for interfitting with a spiral shaped wrap on a second scroll plate to thereby form a series of moveable, crescent-shaped pockets which reduce in volume as the plates rotate relative to each other about the center point;

said end plate having a first pressure equalizing passage formed through the plate at a distance from said center point and a second pressure equalizing passage formed through the plate at a distance from said center point, wherein said first and second pressure equalizing passages are positioned at locations in the end plate that prevent said first and second pressure equalizing passages from simultaneously being completely blocked by the spiral shaped wrap of the second plate and from simultaneously being open in different crescent shaped pockets at any time when the plates rotate relative to each other.

8. The scroll plate of claim 7, wherein a line from said center point to said first pressure equalizing passage and a line from said center point to said second pressure equalizing passage define an angle greater than or equal to 90° and less than or equal to 120°.

9. The scroll plate of claim 7, wherein said spiral shaped wrap has a wall thickness, said first and second pressure equalizing passages are holes having a diameter, said wall thickness being greater than or substantially equal to said hole diameter so that the spiral shaped wrap completely covers each hole at some time when the plates rotate relative to each other.

10. The scroll plate of claim 9, wherein said wall thickness is substantially equal to said hole diameter.

11. The scroll plate of claim 7, wherein said end plate has third and fourth pressure equalizing passages formed through the plate, said third pressure equalizing passage being formed at a distance from said center point and offset 180° from said first pressure equalizing passage, said fourth pressure equalizing passage being formed at a distance from said center point, wherein said third and fourth pressure equalizing passages are positioned at locations in the end plate that prevent said third and fourth pressure equalizing passages from simultaneously being completely blocked by the spiral shaped wrap of the second plate at any time when the plates rotate relative to each other.

12. The scroll plate of claim 11, wherein a line from said center point to said third pressure equalizing passage and a line from said center point to said fourth pressure equalizing passage define an angle greater than or equal to 90° and less than or equal to 120°.

13. A scroll-type fluid compressor, comprising a pair of scroll plates, each having an end plate on which a spiral shaped wrap is located; said scroll plates being arranged to interfit said spiral shaped wraps thereby defining an interior space comprising a series of movable, crescent shaped pockets which reduce in volume as they move radially inwardly towards a center point during an orbiting cycle in which one of the scroll plates rotates relative to the other scroll plate;

at least one back-pressure pocket located adjacent to one of the scroll plates;

first and second pressure equalizing passages formed in one of the end plates, the pressure equalizing passages interconnecting said interior space with said at least one back-pressure pocket, said first pressure equalizing passage formed at a distance from a center point of one of the scroll plates, said second pressure equalizing passage being formed at a distance from said center point, wherein said first and second pressure equalizing passages are positioned at locations in the end plate that permit said first and second pressure equalizing passages to be in the same crescent shaped pocket at some time, but prevent said first pressure equalizing passage from being open in a crescent shaped pocket at the same time said second pressure equalizing passage is open in a different crescent shaped pocket when the plates rotate relative to each other to thereby prevent pressure leakage between high and low pressure crescent shaped pockets.

14. The scroll-type fluid compressor of claim 13, wherein a line from said center point to said first pressure equalizing passage and a line from said center point to said second pressure equalizing passage define an angle greater than or equal to 90° and less than or equal to 120°.

15. The scroll-type fluid compressor of claim 13, further including third and fourth pressure equalizing passages formed in the same end plate as the first and second pressure equalizing passages, wherein said third and fourth pressure equalizing passages are positioned at locations in the end plate that permit said third and fourth pressure equalizing passages to be in the same crescent shaped pocket at some time when the plates rotate relative to each other.

16. The scroll-type fluid compressor of claim 15, wherein said third pressure equalizing passage is formed at a distance from said center point and offset 180° from said first pressure equalizing passage, said fourth pressure passage is formed at a distance from said center point, and a line from said center point to said third pressure equalizing passage and a line from said center point to said fourth pressure equalizing passage define an angle greater than or equal to 90° and less than or equal to 120°.

17. The scroll-type fluid compressor of claim 13, wherein each of said spiral shaped wraps has a wall thickness, said first and second pressure equalizing passages are holes having a diameter, said wall thickness being greater than or substantially equal to said hole diameter so that the spiral shaped wrap completely covers each hole at some time when the plates rotate relative to each other.

18. The scroll-type fluid compressor of claim 17, wherein said wall thickness is substantially equal to said hole diameter.

19. The scroll-type fluid compressor of claim 13, wherein said pressure equalizing passages are formed in an orbiting scroll plate which is caused to orbit relative to a stationary scroll plate.

20. The scroll-type fluid compressor of claim 13, wherein said pressure equalizing passages are formed in a stationary scroll plate about which an orbiting scroll plate is caused to orbit.

21. A scroll-type fluid compressor, comprising a pair of scroll plates, each having an end plate on which a spiral shaped wrap is located; said scroll plates being arranged to interfit said spiral shaped wraps thereby defining an interior space comprising a series of movable, crescent shaped pockets which reduce in volume as they move radially inwardly towards a center point during an orbiting cycle in which one of the scroll plates rotates relative to the other scroll plate;

a back-pressure pocket located adjacent to one of the scroll plates;

first and second pressure equalizing passages formed in one of the end plates, the pressure equalizing passages interconnecting said interior space with said back-pressure pocket, said first pressure equalizing passage formed at a distance from said center point, said second pressure equalizing passage being formed at a distance from said center point, wherein said first and second pressure equalizing passages are positioned at locations in the end plate that prevent said first and second pressure equalizing passages from simultaneously being completely blocked by the spiral shaped wrap of the second plate and from simultaneously being open in different crescent shaped pockets at any time when the plates rotate relative to each other.

22. The scroll-type fluid compressor of claim 21, wherein a line from said center point to said first pressure equalizing passage and a line from said center point to said second pressure equalizing passage define an angle equal to or greater than 90° and equal to or greater than 120°.

23. The scroll-type fluid compressor of claim 21, further comprising third and fourth pressure equalizing passages formed in the same end plate as the first and second pressure equalizing passages, wherein said third and fourth pressure equalizing passages are formed at locations in the end plate that prevent said third and fourth pressure equalizing passages from simultaneously being completely blocked by the spiral shaped wrap of the other plate at any time when the plates rotate relative to each other.

24. The scroll-type fluid compressor of claim 23, wherein said third pressure equalizing passage is formed at a distance from said center point and offset 180° from said first pressure equalizing passage, said fourth pressure passage is formed at a distance from said center point, and a line from said center point to said third pressure equalizing passage and a line from said center point to said fourth pressure equalizing passage define an angle greater than or equal to 90° and less than or equal to 120°.

25. The scroll-type fluid compressor of claim 21, wherein each of said spiral shaped wraps has a wall thickness, said first and second pressure equalizing passages are holes having a diameter, said wall thickness being greater than or substantially equal to said hole diameter so that the spiral shaped wrap completely covers each hole at some time when the plates rotate relative to each other.

26. The scroll-type fluid compressor of claim 25, wherein said wall thickness is substantially equal to said hole diameter.

27. The scroll-type fluid compressor of claim 21, wherein said pressure equalizing passages are formed in an orbiting scroll plate which is caused to orbit relative to a stationary scroll plate.

28. The scroll-type fluid compressor of claim 21, wherein said pressure equalizing passages are formed in a stationary scroll plate about which an orbiting scroll plate is caused to orbit.

29. A method of operating a scroll-type fluid compressor, comprising providing a pair of scroll plates, each having an end plate on which a spiral shaped wrap is located in an arrangement in which said spiral shaped wraps interfit to define an interior space comprising a series of movable, crescent shaped pockets which reduce in volume as they move radially inwardly towards a center point during an orbiting cycle in which one of the scroll plates orbits relative to the other scroll plate;

rotating said orbiting scroll plate relative to the other scroll plate to cause said crescent shaped pockets to move radially inwardly and increase in pressure;

providing continuous communication between said interior space and a back pressure pocket located adjacent to one of said scroll plates through pressure equalizing passages formed through one of the end plates while preventing communication between crescent shaped pockets at different pressures by preventing said first and second pressure equalizing passages from simultaneously being open in different crescent shaped pockets.

30. The method of operating a scroll-type fluid compressor of claim 29, including positioning first and second pressure equalizing passages in the same crescent shaped pocket at some time when the plates rotate relative to each other.

31. The method of operating a scroll-type fluid compressor of claim 30, including positioning third and fourth pressure equalizing passages in the same crescent shaped pocket at some time when the plates rotate relative to each other.

32. The method of operating a scroll-type fluid compressor of claim 29, including preventing first and second pressure equalizing passages from simultaneously being completely blocked by the spiral shaped wraps of the plates at any time when the plates rotate relative to each other.

33. The method of operating a scroll-type fluid compressor of claim 32, including preventing third and fourth pressure equalizing passages from simultaneously being completely blocked by the spiral shaped wraps of the plates at any time when the plates rotate relative to each other.

* * * * *